US005129803A

United States Patent [19]

Nomura et al.

[11] Patent Number: 5,129,803

[45] Date of Patent: Jul. 14, 1992

[54] CONCRETE LEVELING MACHINE

[75] Inventors: Hajime Nomura; Yasuo Kajioka; Tomio Komine; Akira Okada; Tomoo Shokawa; Toshio Kumagai; Kazumi Okuzumi, all of Tokyo, Japan

[73] Assignee: Shimizu Construction Co., Ltd., Japan

[21] Appl. No.: 355,909

[22] Filed: May 23, 1989

[30] Foreign Application Priority Data

May 24, 1988 [JP] Japan ..... 63-126197
Aug. 2, 1988 [JP] Japan ..... 63-102683[U]
Aug. 5, 1988 [JP] Japan ..... 63-195351

[51] Int. Cl.[5] ..... E01C 19/40

[52] U.S. Cl. ..... 425/62; 404/84; 404/102; 404/133; 425/63; 425/141; 425/456

[58] Field of Search ..... 425/62-64, 425/141, 150, 431, 456; 404/84, 101, 102, 133

[56] References Cited

U.S. PATENT DOCUMENTS 786,261 4/1905 Brichta ..... 425/431
3,069,983 12/1962 Pizzarotti et al. ..... 404/84
3,359,875 12/1967 Reider ..... 404/102
3,541,932 11/1970 Hodson ..... 404/102
3,699,855 10/1972 Leister ..... 404/102
3,953,145 4/1976 Teach ..... 404/84
4,371,287 2/1983 Johansson ..... 404/84
4,493,585 1/1985 Axer ..... 404/102
4,655,633 4/1987 Somero et al. ..... 404/84
4,828,428 5/1989 Anderson ..... 404/102

FOREIGN PATENT DOCUMENTS 62-137362 6/1987 Japan .
62-137363 6/1987 Japan .
63-194068 8/1988 Japan .
63-206566 8/1988 Japan .

*Primary Examiner*—James C. Housel
*Attorney, Agent, or Firm*—Scully, Scott, Murphy & Presser

[57] ABSTRACT

A concrete leveling machine is provided which propels itself over the surface of laid concrete and by use of rotating augers or oscillating stabilizers and a temper, levels and finishes the surface to a prescribed level and condition. A laser reference beam transmitted over the surface is detected by detectors attached to the leveling section of the machine and deviation of the level of the detectors from a reference level is adjusted so that the leveling section is also brought to a level required to produce the desired surface level. The machine is turned by a turntable integral with the main body which lifts the machine allowing it to turn by differential drive to its drive wheels.

13 Claims, 12 Drawing Sheets

CONCRETE LEVELING MACHINE

BACKGROUND OF THE INVENTION

1. Field of the Invention

The present invention relates to a machine for leveling the surface of large areas of concrete just after the concrete has been poured.

2. Prior Art

Generally in laying concrete, after the concrete has been poured the concrete surface must be leveled accurately and the surface smoothed to give an attractive appearance. To obtain a smooth level surface with the concrete at a prescribed thickness, it is necessary to use a vibrator to compact the concrete and then level the surface of the concrete using a straight-edge and finally smooth the surface with a flat object to float the mortar to the surface.

In carrying out the leveling operation the straight edge is positioned between several reference points and the surface level is corrected to coincide with the straight edge. This operation requires the reference points to first be accurately set and then requires laborious filling and scraping of the concrete surface so that it coincides with the prescribed surface slope and level. Since the work is carried out by many persons the quality of the work is variable depending on the workers skill and the working conditions. Also since the workers must bend over for much of the work, they are subjected to unreasonable discomfort.

Further since the availability of skilled workers who can do this type of work is decreasing it is becoming more difficult every year to obtain suitable workers.

SUMMARY OF THE INVENTION

It is therefore an object of the present invention to solve the above problems by providing a mechanized concrete leveling machine which rides over the laid concrete surface being propelled along by a drive unit attached to a platform of the leveling machine and having a leveling device attached behind the platform which can be inclined relative to the concrete surface.

With a leveling machine constructed as above, wheels or tracks in the drive unit provide traction against the ground or reinforcing rods arranged in the laid concrete, and stabilizer tracks, lying on each side of the platform running parallel to the direction of motion, slide along the ground or reinforcing rods, to stabilize the leveling machine.

An auger fitted to the leveling section of the machine scrapes the concrete surface, and by adjusting the position and alignment of this auger the surface of the concrete can be gradually formed to the required level and slope with continuous movement of the machine over the surface of the laid concrete. Adjustment of the auger is governed by either a laser beam leveling system or other system which can detect deviation from a specified slope and level such as a gyroscopic device, spirit level device or inclinometer. To change the direction of the concrete leveling machine as it moves over the concrete surface, a differential drive is used to turn the wheels or tracks at different speeds, and to reduce the force required for turning, a lifting mechanism is used to raise the machine at he time of turning.

DESCRIPTION OF THE PREFERRED EMBODIMENTS OF THE INVENTION

Figure 1:
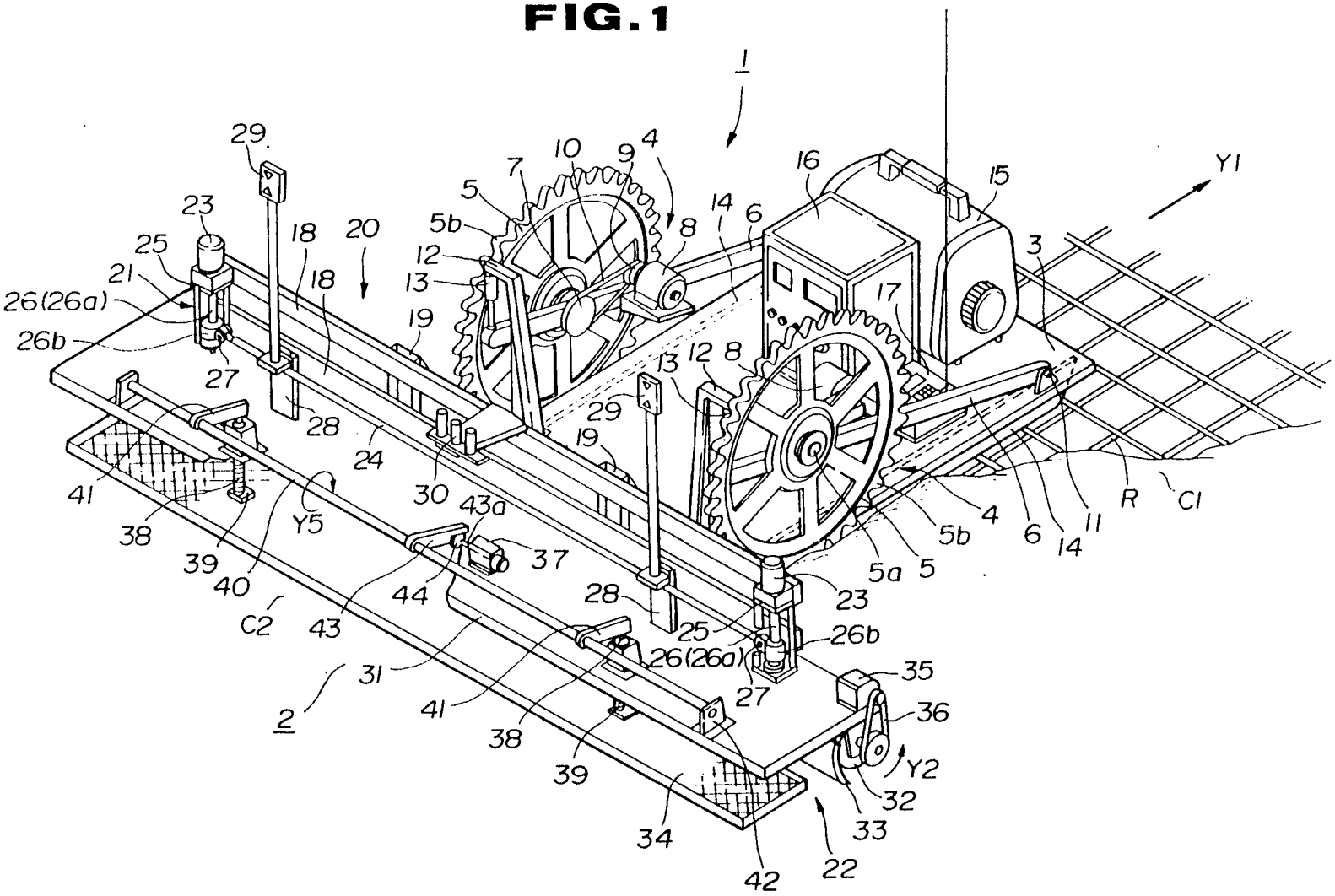
FIG. 1 is a perspective view of a first embodiment of a concrete leveling machine of this invention.

Various embodiments of the present invention will now be described with reference to the accompanying drawings in which the same reference numerals are used to designate like parts or elements in several different views.

FIG. 1 to FIG. 6 depict a first preferred embodiment of a concrete leveling machine of this invention. As shown in FIG. 1 the concrete leveling machine 1 is made up of a drive system 4 and a leveling unit 2 attached to the rear of the drive system 4 (arrow Y1 depicts the direction of travel of the leveling machine 1). The drive system 4 is supported on a flat platform 3 and has a pair of wheels 5 located on either side of the platform 3. These wheels 5 ride on reinforcing rod R buried in the concrete and by their rotation the platform 3 is driven in the direction of the arrow Y1. Around the perimeter of each wheel 5 is a track 5*b* (made of a resilient material such as rubber) with a pitch to coincide with the spacing of the reinforcing rod R, to provide grip with the reinforcing rod R. This grip is more clearly illustrated in FIG. 2

The axles 5*a* of wheels 5 are rotatively fitted to wheel arms 6 and project out from the side of the wheel arm 6 opposite to the wheel 5. To each respective protrusion is rigidly attached a pulley 7, and to each wheel arm 6 is attached a motor 8 fitted with a drive pulley 9 which is connected to the pulley 7 with a belt 10 to transmit drive from the motor 8 to the wheel 5. The forward end of each wheel arm 6 is attached to the platform 3 by means of a pin 11 so that it can swing about the pin 11 relative to the platform 3, and the other end is attached to a damper frame 12 by means of damper 13. The dampers 13 are provided so that the wheels 5 can go up and down corresponding to a change in load on the wheels 5. The dampers 13 move to help keep the contact force of the wheels 5 with the reinforcing rod R constant.

Figure 2:
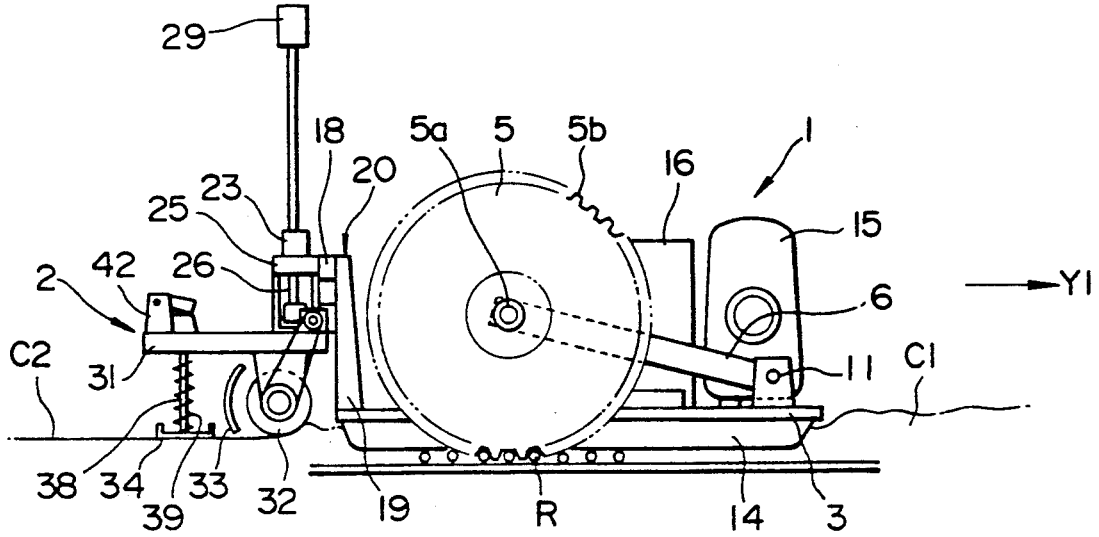
FIG. 2 is a schematic elevation view of the leveling machine of FIG. 1.

Also as shown in FIG. 1 and FIG. 2, running along the under face of the support platform 3 in the support platform progress direction and on either side of the centerline, are provided two parallel stabilizers 14. These parallel stabilizers 14 spread the load of the leveling machine over a number of reinforcing rods R, decreasing the deformation of the reinforcing rods, and also keeping the leveling machine stable when it is moving. The lower surfaces of the stabilizers 14 are at approximately the same level as the bottom of the wheels 5 as shown in FIG. 2 and the lengths are a little shorter than the platform 3. The material used for the surface of the tracks of the stabilizers 14 is one with a low coefficient of friction such as a high density type polyethylene etc. so that the force to drive the leveling machine is kept to a minimum. During drive the total weight of the machine is supported by a force W1 exerted on the wheels 5 and a force W2 exerted on the stabilizers 14 so that the friction force in the opposite direction to the motion of the stabilizers 14 is $\theta \times W_2$ where $\theta$ is the coefficient of friction of the stabilizer track material.

Mounted on the upper surface forward edge of the platform 3 is a generator 15 to provide electricity for the drive motors 8 and other equipment, and a control unit 16 for controlling the drive motors 8 and motor for adjusting the attitude of the leveling unit 2. Also there is a radio receiver 17 for remotely controlling the speed etc. The generator 15, control unit 16, and radio receiver 17 can be located at any suitable position on the platform 3, however to provide a balance with the leveling unit 2 it is better if they are located towards the front of the platform 3.

As shown in FIG. 1 the leveling unit 2 consists of a support frame 20, an attitude adjusting mechanism 21 and a leveling section 22. The support frame 20 is arranged at the rear of the platform 3 and connects the leveling unit 2 to the platform 3. It is made up of two parallel upper and lower beams 18 connected together by support arms 19 with the bottom ends of the support arms 19 semi-rigidly connected to the platform 3 by shock dampers ( not shown in the figure) to make the support frame 20 as one with the platform 3.

One attitude adjusting mechanism 21 is attached to each end of the support frame 20 and the leveling section 22 is connected to the attitude adjusting mechanism 21 by a rod 24 arranged close to the support frame 20. By drive of an attitude control motor 23, the rod 24 is moved up and down, and leveling section 22 is inclined so the leveling surface agrees with the required top surface level of the concrete.

Figure 4:
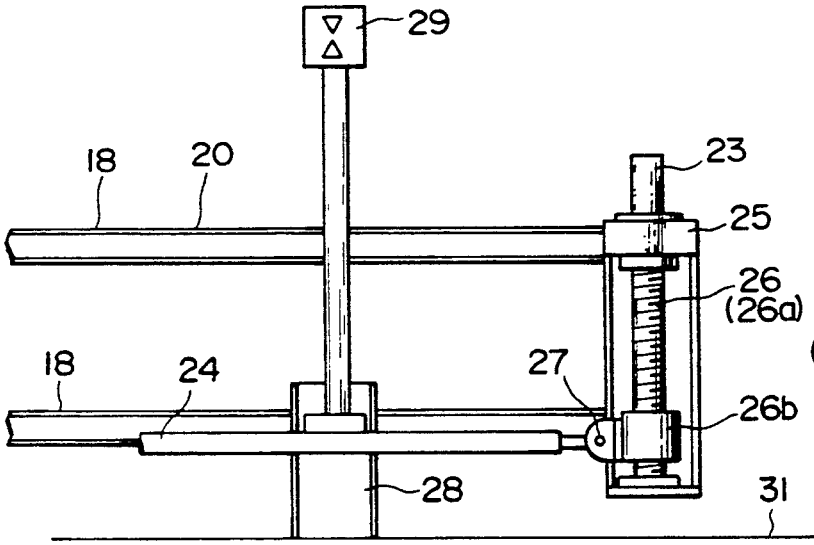
FIG. 4 is an elevation view of one end of a support frame.
Figure 5:
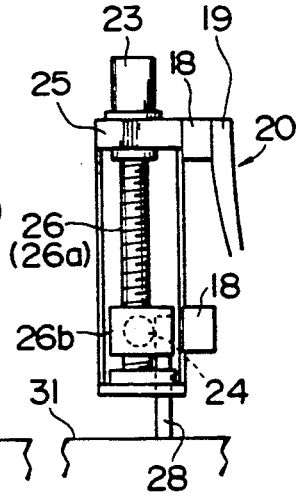
FIG. 5 is a side view of the support frame of FIG. 4.

This is more clearly shown in FIG. 4 and FIG. 5 showing one of the attitude control motors 23 provided at one end of the support frame 20 (the other end is not shown in the figure) and fixed to the support frame 20 by motor bracket 25. The motor shaft is connected to a screw 26*a* of ball screw 26 which is rotatably fitted inside the motor bracket 25. A ball screw nut 26*b* is connected to the end of the rod 24 by a pin 27 which allows rotatable movement about the axis of the pin 27 but prevents the nut 26*b* from rotating with the screw 26*a*. By the drive of the attitude control motor 23 the screw 26*a* is turned and the rod 24 is moved up and down depending on the drive direction. As shown in FIG. 1, a connecting bracket 28 attached to a leveler platform 31 is fixed near each end of the rod 24 so that the leveling section 22 moves up and down as one with the rod 24. Attached to the top of each connecting bracket 28 is a rod which supports a lateral attitude laser detector 29 used to detect a beam from a laser level (not shown) attached to a post or the ground to provide a reference beam. This reference beam is set to the desired level for the surface of the concrete C1 and if the laser beam striking the lateral attitude laser detector 29 moves from a central zone position on the lateral attitude laser detector 29 then a revision signal is sent to the control unit 16 on the platform 3 to adjust the attitude of the leveling unit 2. This is done by operating the attitude control motors 23 in accordance with the revision signal so that the ends of the rod 24 are raised or lowered individually s that the reference laser beam strikes the central zone of the lateral attitude laser detector 29. Accordingly the attitude of the leveling section 22, which is connected by connecting bracket 28 to the rod 24, becomes that necessary to form the top surface of the concrete to the desired level. In trying to cancel the revision signal sent from the lateral attitude laser detector 29 to the control unit 16, the attitude control motors 23 can operate to move the leveling section 22 as far as an upper or lower limit. Also it is possible to monitor the attitude condition of the leveling section 22 by having a flashing drive condition indicator light which flashes depending o the revision signal from the lateral attitude laser detector 29.

Figure 3:
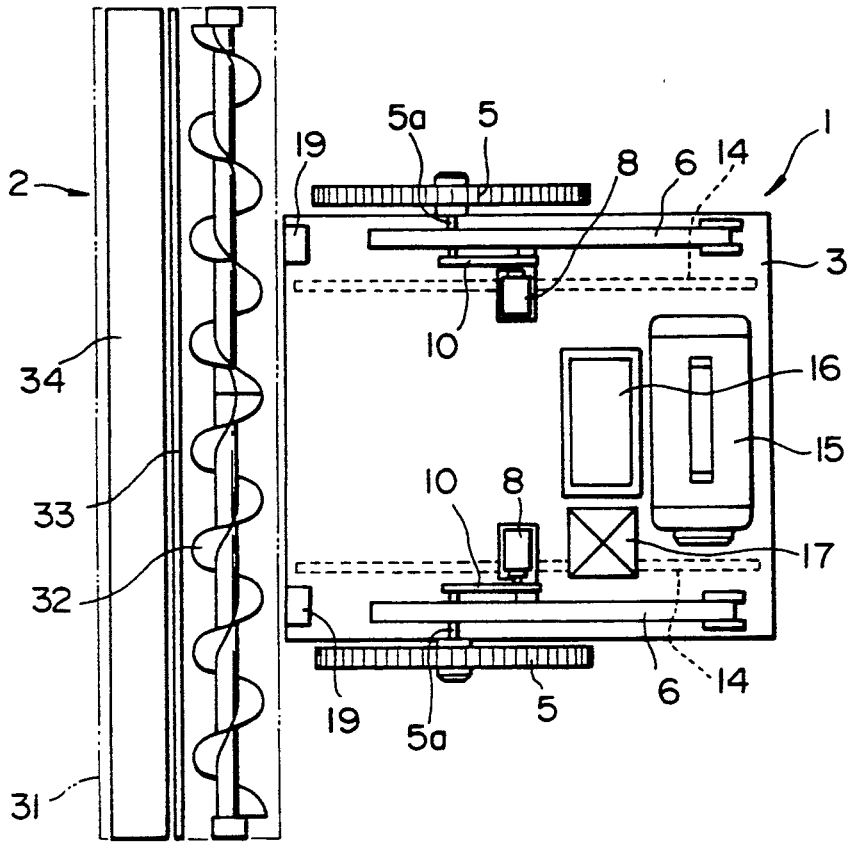
FIG. 3 is a schematic plan view of FIG. 2.

Typically the leveling section 22 consists of the leveler platform 31, the attitude adjusting mechanism 21, the rod 24, a leveling auger 32, a leveling blade 33 and a tamper 34 all attached in a direction transverse to the direction of movement of the leveling machine 1. The leveling auger 32 and the leveling blade 33 are provided to make the surface of the concrete flat and smooth. The leveling auger 32 is driven in the direction of an arrow Y2 in FIG. 1 by an auger motor 35 provided at each outer edge of the leveler platform 31 and connected to the leveling auger 32 axle by a timing belt 36. The shape of the leveling auger 32 is shown in FIG. 3. It consists of a left and right hand screw connected together so that the right half (looking from the direction of motion of the leveling machine) has a left hand spiral and the left half has a right hand spiral so that by rotation of the leveling auger 32, concave or convex surfaces of the concrete C1 (see FIG. 2) are either filled in or scraped off respectively and the scraped off concrete is moved towards the center section (see FIG. 8 with arrows Y3, Y4 indicating the direction of scraping). Further, since the optimum speed of the leveling auger 32 for leveling depends on the thickness and characteristics of the concrete C1 (normal, lightweight, high strength, slump type, etc.), the rotational speed of the leveling auger 32 is controlled to provide the optimum speed. Also the width of the leveling auger 32 is such that any tracks in the laid concrete from the wheels 5 and the stabilizers 14 of the drive system 4 are removed.

As shown in FIG. 2 the leveling blade 33 is provided behind and parallel to the leveling auger 32. This leveling blade 33 further smooths the surface of the concrete C1 after it has been leveled by the leveling auger 32. The tamper 34 gives additional tamping to the concrete surface that has been leveled by the leveling auger 32 so as to settle the coarse aggregate in the concrete and allow mortar paste in the concrete C1 to float to the surface. It is of approximately the same width as the leveling auger 32 and is made of perforated steel plate ( sheet netting) with a perimeter of bent up flat plate for strength and to ensure flatness. The tamper 34 is supported by two tamper support rods 38 attached to the leveler platform 31, and by these support rods 38, it is moved up and down relative to the leveler platform 31. Each support rod 38 is forced down with a spring 39 fitted around it, and its upper end passes through the leveler platform 31 and is rotatably connected to a tamper drive arm 41 attached to a tamper actuator shaft 40. The actuator shaft 40 lies parallel to the tamper 34 and its ends are rotatably attached to the leveler platform 31 by brackets 42. The dead weight of the tamper 34 and the force of the spring 39 is transmitted through the tamper support rods 38 to the actuator shaft 40 making it rotate in the direction of an arrow Y5 in FIG. 1.

A cam follower 43 is fixed to the central section of the actuator shaft 40, with its lower face 43*a* contacting an eccentric cam 44 attached to the shaft of a tamper motor 37. By operation of the tamper motor 37, the actuator shaft 40 is made to rotate back and forth transmitting this movement through tamper drive arms 41 to the tamper support rods 38 and finally to the tamper 34 so that the tamper 34 shakes up and down and the surface of the concrete C1 is tamped.

Figure 6:
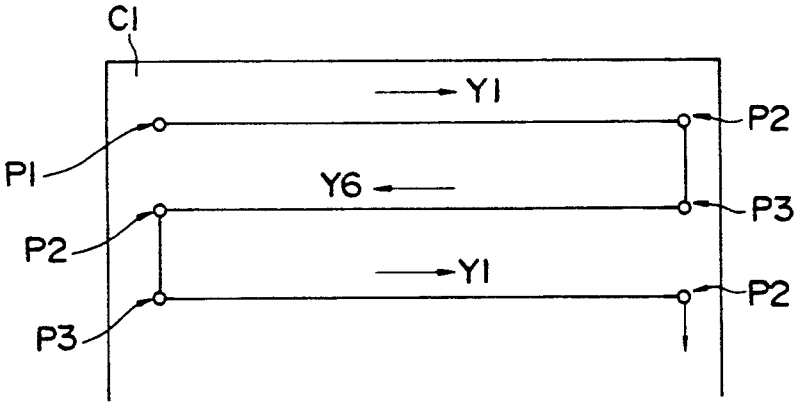
FIG. 6 shows a path followed by the leveling machine of this invention as it levels an area of laid concrete.

The leveling operation with the leveling machine constructed as shown in FIG. 1 will be explained with reference to FIG. 6. First the leveler platform 31 is adjusted to its upper limit with the attitude control motors 23 of the attitude adjusting mechanism 21, then the leveling machine 1 is placed at starting point Pl with the wheels 5 and stabilizers 14 resting on the reinforcing rod R placed in the concrete C1. Then by the attitude control motors 23, the height of the lateral attitude laser detectors 29 is adjusted so that the laser beam from the reference laser attached to a pole or supported on the ground ( not shown in the figure) strikes the lateral attitude laser detectors 29 at a central zone position so that the attitude of the leveling section 22 is adjusted to the necessary level to provide the desired upper surface level of the concrete C1. Then the auger motor 35 and the tamper motor 37 are switched on to drive the leveling auger 32 and the tamper 34 and the motors 8 are switched on to drive the wheels 5 to start the leveling operation. The wheels 5 are rotated in the same direction so that the leveling machine 1 moves along a straight path (movement is in direction of Y1 shown by the arrow in FIG. 6). As the leveling machine 1 moves along, the attitude control motors 23 are operated to adjust the attitude of the leveling section 22 to suit the required surface level. Accordingly, the concrete surface is scraped by the leveling auger 32 and the leveling blade 33, and is smoothed by the tamper 34 so as to give the desired surface condition and level to the concrete.

When the leveling machine 1 reaches the first turning point P2 it is turned through 90° by rotation of one wheel 5 with the other wheel 5 fixed. Then after overlapping any areas where a track has been left, both wheels are rotated together so that the leveling machine 1 moves to the second turning point P3. Then once again the leveling machine 1 is turned through 90° by rotating only one wheel so as to face direction Y6 shown in FIG. 6 and the leveling machine 1 repeats the leveling operation over the concrete surface C1. By repeating this operation the level of the surface is brought to the required level.

As explained above in the description of this preferred embodiment, the leveling section 22 including the leveling auger 32, the leveling blade 33 and the tamper 34 is driven along the surface of the laid concrete C1 by the drive system 4 and at this time the leveling section 22 attitude is adjusted to conform to the required concrete surface level by the attitude adjusting mechanism 21 so that the surface of the laid concrete C1 is made to coincide point by point with the required level. Accordingly compared to the conventional leveling operation methods, the required manpower can be reduced, and also human error can be reduced and surface accuracy greatly improved.

With this preferred embodiment the leveling auger 32 in the leveling section 22 rotates to move all the excess concrete to the central section of the leveling auger 32 so that there is no excess concrete discharged to the outside of the leveling machine 1. Consequently any outer concavities in the surface of the concrete may not be filled. To solve this problem is the purpose of a second embodiment which will be explained with reference to FIG. 7 to FIG. 9.

Figure 7:
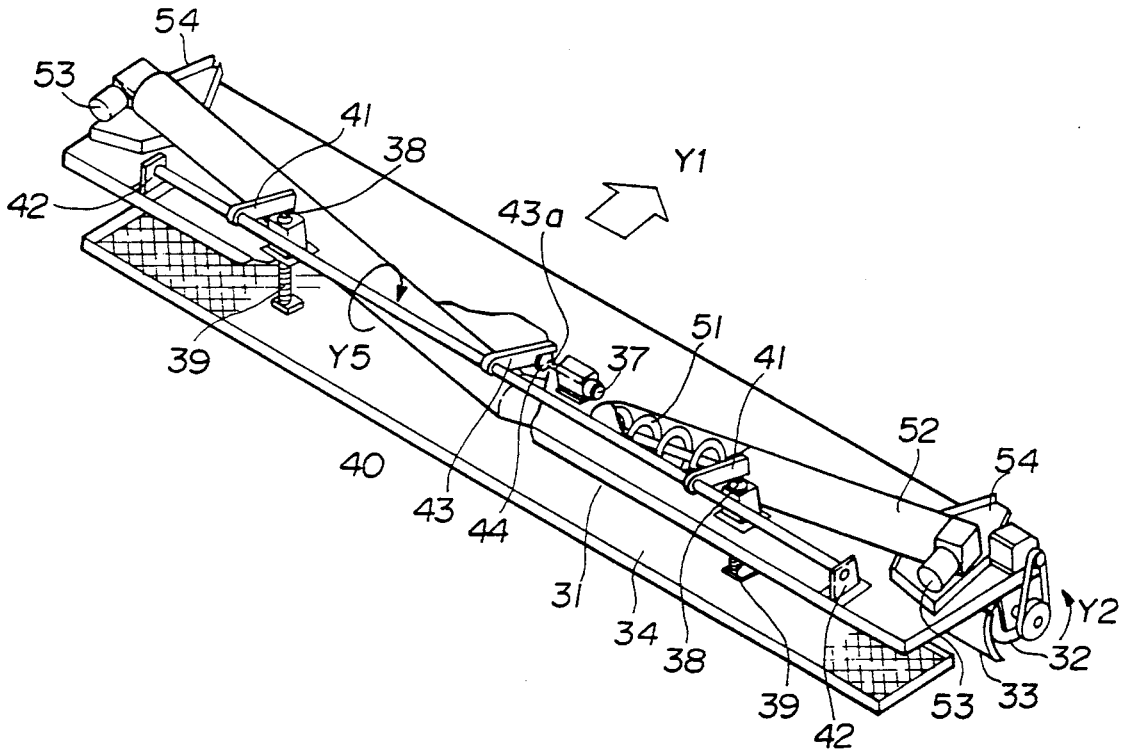
FIG. 7 shows a perspective view of a second embodiment of the leveling machine of this invention including an auger and return flow auger.
Figure 8:
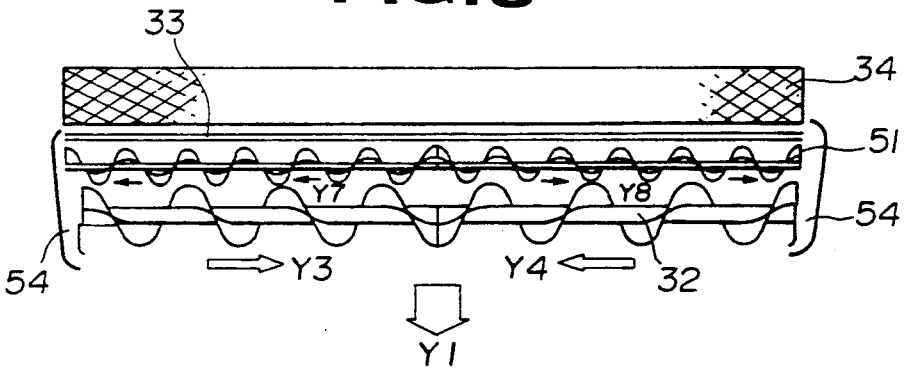
FIG. 8 shows a schematic plan view of the leveling machine of FIG. 7.
Figure 9:
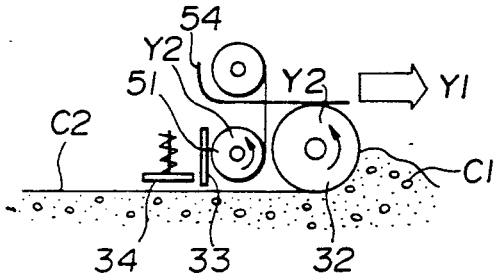
FIG. 9 shows a schematic side view of FIG. 8

The second embodiment has a similar drive system 4 to the first embodiment but the leveling section 22 is different. For simplicity components similar to the first embodiment are numbered with the same numbers. As shown in FIG. 7 to FIG. 9 a concrete return flow auger 51 is provided between the leveling auger 32 and leveling blade 33 of the leveling section 22. This return flow auger rotates in the same direction to the leveling auger 32 but, as shown in FIG. 8, the screw directions of the right half and left half (looking from direction Y1 in FIG. 7 to FIG. 9) are opposite to the screw directions of the leveling auger 32, so that by rotating in the same direction as the leveling auger 32, the concrete is cleared away from the center section of the leveling auger 32 and transported to the outer ends (shown by arrows Y7 and Y8 in FIG. 9). As shown in FIG. 7, the return flow auger 51 is enclosed in a casing 52 and extends out with an upwards incline to each side from a central position behind the center of the leveling auger 32 and at the same height as the leveling auger 32. It passes through the leveler platform 31 on each side of the center line and is driven by the return flow motors 53, provided at both ends of the casing 52, in the same direction as the leveling auger 32. The rotation speed of the return flow motors 53 is controlled to control the return flow of the concrete from the return flow auger 51. Underneath both ends of the casing 52 is an outlet (not shown in the figure) and the concrete transferred to both ends falls through this outlet into chutes 54 provided in the upper face of the leveler platform 31. The front ends of the chutes 54 extend along the top of the leveler platform 31 to a position at the ends of the leveling auger 32 and are bent to face down so that the discharge location of the concrete from the chutes 54 lines up with the ends of the leveling auger 32. The return flow auger 51 has a thin screw section called a ribbon screw which mixes the concrete scraped to the center by the leveling auger 32 as it is transferred along, so that the body of the concrete is not separated out.

With this second embodiment, the concrete scraped away by the leveling auger 32 is fed back to the outer ends of the leveling auger 32 while being agitated, and is once again spread by the leveling auger 32, thereby improving the leveling effectiveness and surface condition, especially in the case of concrete with concave surface areas. This solves the problem with the previous embodiment where in the case of extreme concavities or concavities at the ends of the leveling auger 32, if the supply of concrete is not sufficient, these areas cannot be leveled.

In the above embodiments, the drive system 4 uses wheels 5 for driving the machine over the surface of the concrete, however the leveling machine of this invention is not limited to this method of propulsion and it is possible to have various other methods such as for example endless type tracks instead of wheels for driving the leveling machine. Also the arrangement and number of wheels 5 is not limited and the number of stabilizers 14 can also be changed. Further it is not always necessary to have a track **5*b* attached to the outer perimeter of wheel 5 and even a flat smooth surface is possible. Also the leveling section 22 is not limited to the leveling auger 32, the return flow auger 51, the leveling blade 33 and the tamper 34** and other components can also be considered.

Figure 10:
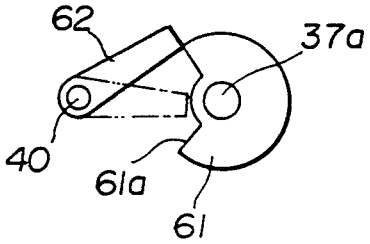
FIG. 10 is a possible tamper drive cam.

With the tamper 34, the use of a cam and cam follower to produce the up and down movement is not the only way and other methods such as a direct drive actuator etc. can be used. Further when using a cam, the arrangement is not limited to that of an eccentric cam 44 and cam follower 43 of the above embodiment. For example as shown in FIG. 10, it is also possible to have a cam disc 61 attached to a shaft **37*a* of the tamper motor 37 (refer to FIG. 1 and FIG. 7 ), with the cam disc 61 formed with a contact surface and slot 61*a*. A cam lever 62 is attached to the actuator shaft 40 and in this case, at the point when the cam lever 62 falls into the slot 61*a*, the cam lever 62 becomes disconnected from the cam disc 61 so that the tamper 34 is impacted on the concrete surface under the force of the spring 39 and the dead weight of the tamper 34**, producing a desirable tamping action. The tamping intensity can be changed by changing the spring force.

However a problem with the leveling unit 2 of the leveling machine 1 is that the attitude of the leveling section 22 in a longitudinal plane cannot be adjusted and is affected by the attitude of the drive system 4 since it is fixedly connected to the platform 3 through rod 24.

Figure 11:
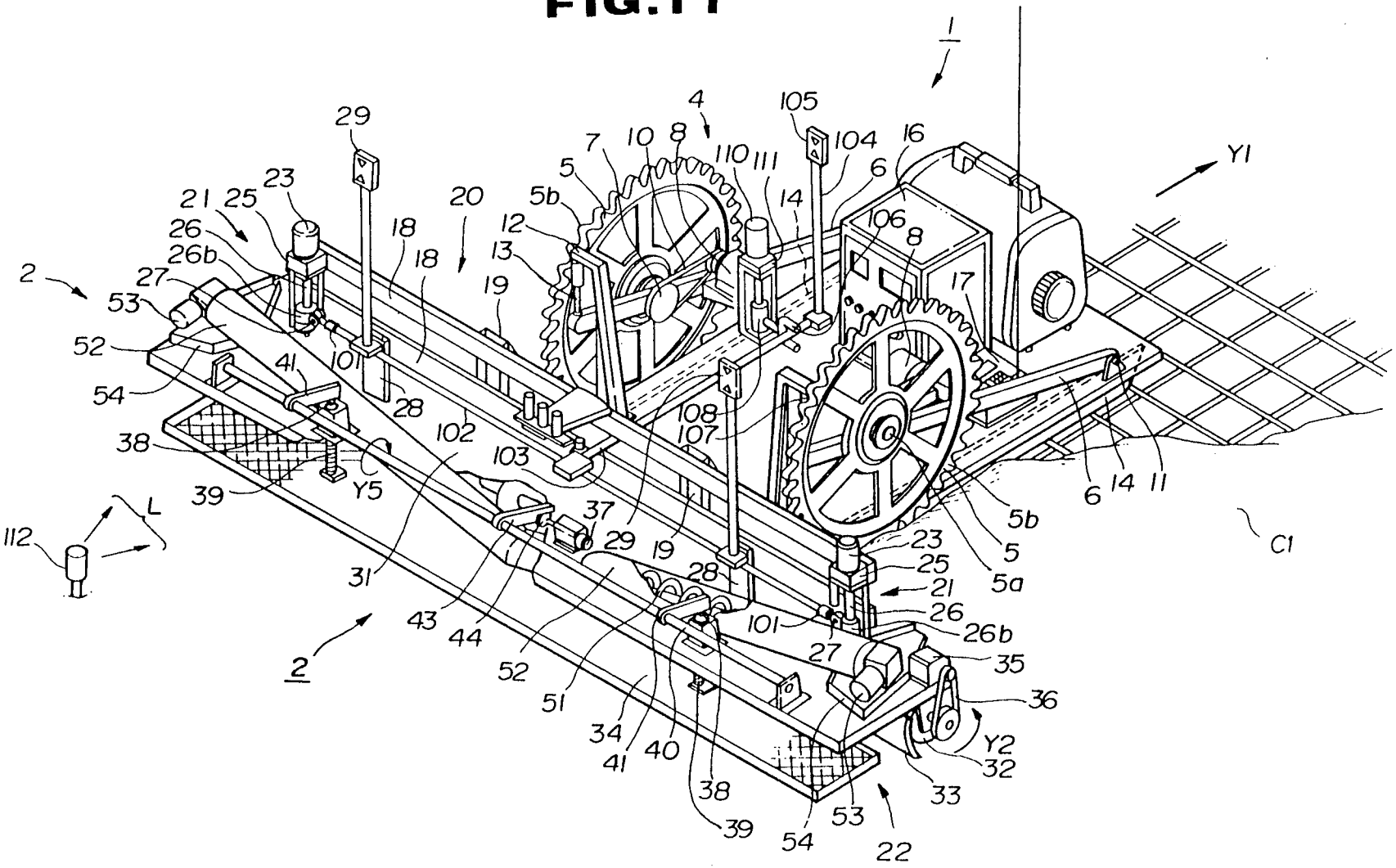
FIG. 11 is a perspective view of a third embodiment of the leveling machine of this invention.
Figure 12:
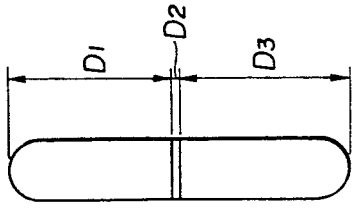
FIG. 12 shows the arrangement of zones on lateral and longitudinal attitude laser detectors.

To enable the longitudinal attitude to be adjusted independent of the drive system 4 is the object of a third embodiment depicted in FIG. 11 and FIG. 12. In this embodiment the leveling section 22 is connected to the attitude adjusting mechanism 21 of the support frame 20 through two rotatable couplings 101. These couplings connect a rotatable rod 102 to nuts **26*b* which are the same as in the first and second embodiments. These couplings 101 allow rotation of the rotatable rod 102 about its axis and also allow rotation about the axis of the pins 27 which connect the couplings to the nuts 26*b*. However they prevent nuts 26*b* from rotating with the ball screws 26. Consequently the leveling section 22 is able to rotate about the axis of the rotatable rod 102 so that the attitude in a longitudinal plane can be changed. To control this attitude change, a horizontal arm 103 is fixedly attached to a center area of the rotatable rod 102 extending forward, and to the forward end of this arm 103 is fixedly attached the bottom end of a vertical rod 104 extending upwards. To the top of this vertical rod 104 is attached a longitudinal attitude detector 105. The horizontal arm 103 passes between a fork 106 on the fork end of an approximately horizontal bar 107, the other end of which is attached to an actuator nut 108 that moves up and down on a screw 109 connected to an actuator drive motor 110 of a longitudinal attitude control mechanism 111. By operation of the actuator drive motor 110 the vertical rod 104 can be raised or lowered thereby changing the height of the detector 105 and also changing the longitudinal attitude of the leveling section 22**.

The actuator drive motor 110 is controlled by signals from the control unit 16 which are based on the position where the light beam strikes the longitudinal attitude laser detector 105 surface. As shown in FIG. 12 the vertical area of the laser detectors is divided into three zones; an upper zone D1, a central zone D2 and a lower zone D3. Depending on which zone the laser reference beam from a laser transmitter 112 (FIG. 11) strikes, the signal from the control unit 16 is changed to operate the actuator drive motor 110 to move the longitudinal attitude laser detector 105 so that the laser beam strikes the central zone. In doing this the leveling section 22 inclination is also changed so that the inclination conforms to the laser reference beam and is appropriate to give the desired slope of the concrete surface.

With the invention constructed in this way the operation will be explained. To carry out leveling the leveling section 22 is first raised to an upper limit by operation of the attitude control motors 23 and actuator drive motor 110. Then the laser reference beam is transmitted from laser transmitter 112 and the levels of each of the laser detectors 29 and 105 are adjusted by the corresponding motors until the beam strikes the respective detectors in the center area D2 (FIG. 12). By this operation the leveling section 22 is adjusted to be parallel to the desired level. Then by operation of the leveling auger 32, the return flow auger 51 the and tamper 34, and the respective drive motors for the platform 3, the laid concrete C1 is first leveled to the correct thickness with the leveling auger 32 by scraping the concrete to the center area and carrying back any surplus with the return flow auger 51 and then the surface is leveled by the leveling blade 33 and smoothed and finished by the tamper 34 as with the second preferred embodiment.

While this operation is being carried out the level of the leveling section 22 in the lateral and longitudinal planes is detected by the two lateral attitude laser detectors 29 and the longitudinal attitude laser detector 105 and adjusted by the attitude adjusting mechanism 21 and the longitudinal attitude control mechanism 111. Accordingly, after leveling, the surface of the concrete C1, is compacted to the prescribed thickness and the upper surface finished to a level and smooth surface.

The above is one example of a preferred construction however depending on design requirements etc., it is possible to change the specifications. For example in this example the construction consists of a longitudinal attitude laser detector 105 with laser transmitter 112 and the lateral laser detectors 29, however it is also possible to have an attitude detecting system using electrically or mechanically operated devices. Using electrical or mechanical devices has an advantage over a laser detector system in that it is not affected by obstructions to the laser beam. With the laser beam system of this embodiment the lateral attitude laser detectors 29, and longitudinal attitude laser detector 105, must be positioned so that the laser beam L is received for all orientations of the leveling machine 1. Therefore there can be no obstacles between the lateral attitude laser detectors 29, the longitudinal attitude detector 105 and the laser transmitter 112.

With the layout of the concrete leveling machine 1, care must be taken with positioning equipment especially around the longitudinal attitude laser detector 105 in the central area of the platform 3, to ensure that equipment does not prevent the beam L from striking the longitudinal laser detector 105.

If an electrical or mechanical inclinometer is used instead of the longitudinal attitude laser detector 105, this will solve the problem of equipment obstruction of the laser beam. Then the lateral attitude laser detectors 29 can be used to detect lateral attitude and provide the necessary signals to operate the lateral attitude adjustment mechanism 21 to level the leveling section 22, and a longitudinal attitude inclinometer can be used to provide an output signal for longitudinal attitude control, so that automatic level control of the leveling section 22 can be accurately and simply achieved.

By moving the concrete leveling machine over the surface of the concrete to be leveled with the level detectors maintained at a desired level position set by the reference laser beam, the surface of the concrete is brought to the desired level with a minimum amount of labor and reference level preparation, and the resulting surface is one that conforms accurately to the specified surface level.

A problem that still remains with the leveling machine however occurs when turning the machine as it moves over the concrete. Due to the resistance to turning imposed by the sideways drag of the stabilizers on the concrete and the adhesion of the concrete to the under surface of the drive platform, a relatively large force is required to turn the machine.

There are various methods to turn the machine such as lifting it manually and turning it, or using a special stand which lifts the machine and turns it. The manual method is appropriate for small machines but for heavy machines this method is impractical as many workers would be required. The use of a turning device is suitable for large machines, however it must be positioned correctly so that the machine does not fall over when being turned. Also it usually includes a drive mechanism to turn a cradle supporting the machine and is consequently complicated, so that in the environment of concrete laying operations, much preventative maintenance is necessary.

With the present invention, the force to turn the machine is supplied by the drive to one wheel with the other wheel locked. However this force acts on the reinforcing rod laid in the concrete and tends to displace and distort the rod from its laid position in the concrete. Generally the location of the rod in the concrete is quite critical to the final strength of the concrete and so any disturbance to the location is undesirable. To reduce this loading on the reinforcing rod when turning, the machine needs to be lifted. Often this necessitates stopping the leveling machine and manual lifting. It is therefore an object of a fifth embodiment to provide a mechanical lifting device to lift the concrete leveling machine when turning and thereby reduce the loading applied to the reinforcing rod laid in the concrete.

Figure 13:
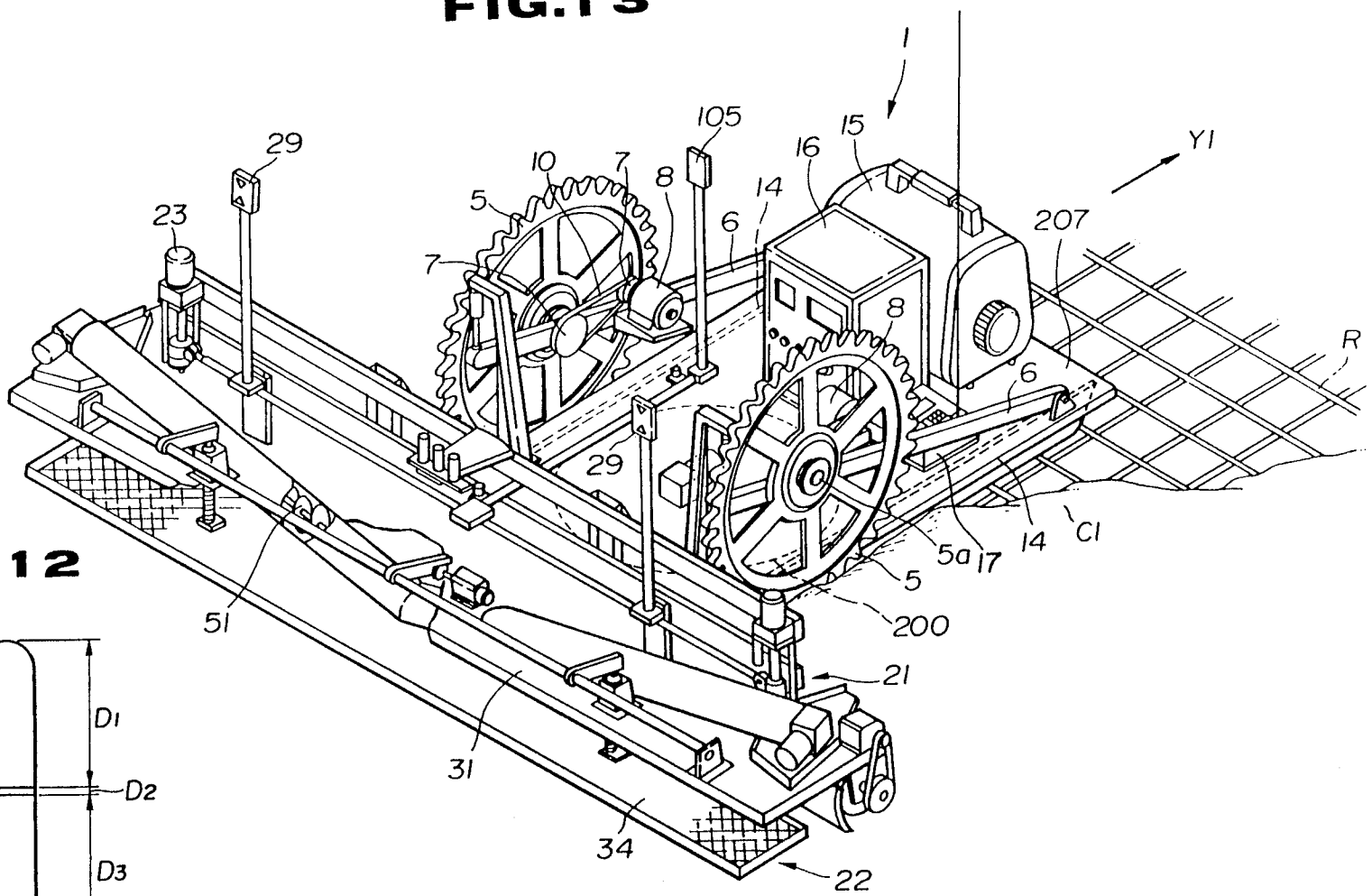
FIG. 13 is a perspective view of a fourth embodiment of the leveling machine of this invention.
Figure 14:
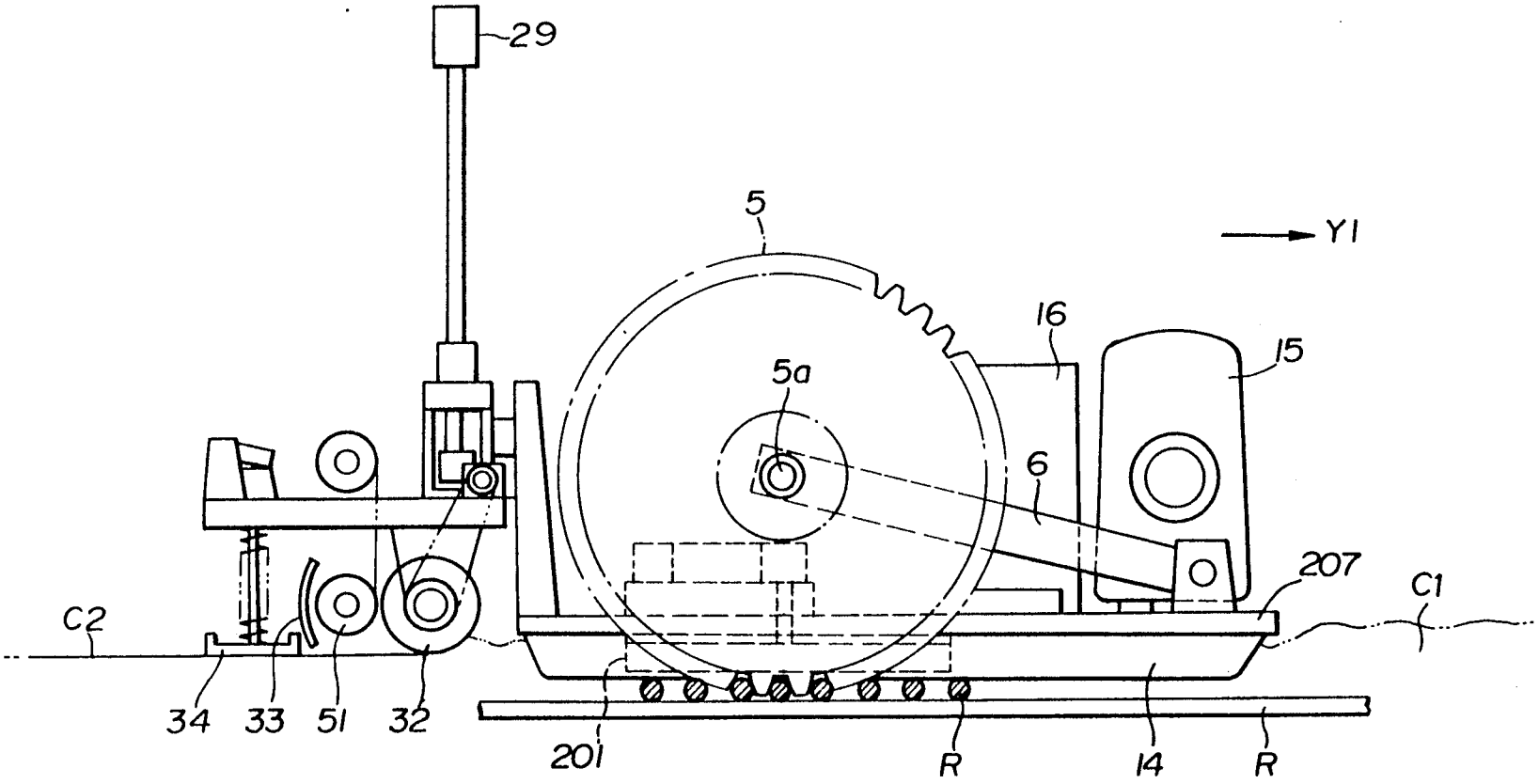
FIG. 14 is a schematic side view of the leveling machine of FIG. 13.
Figure 15:
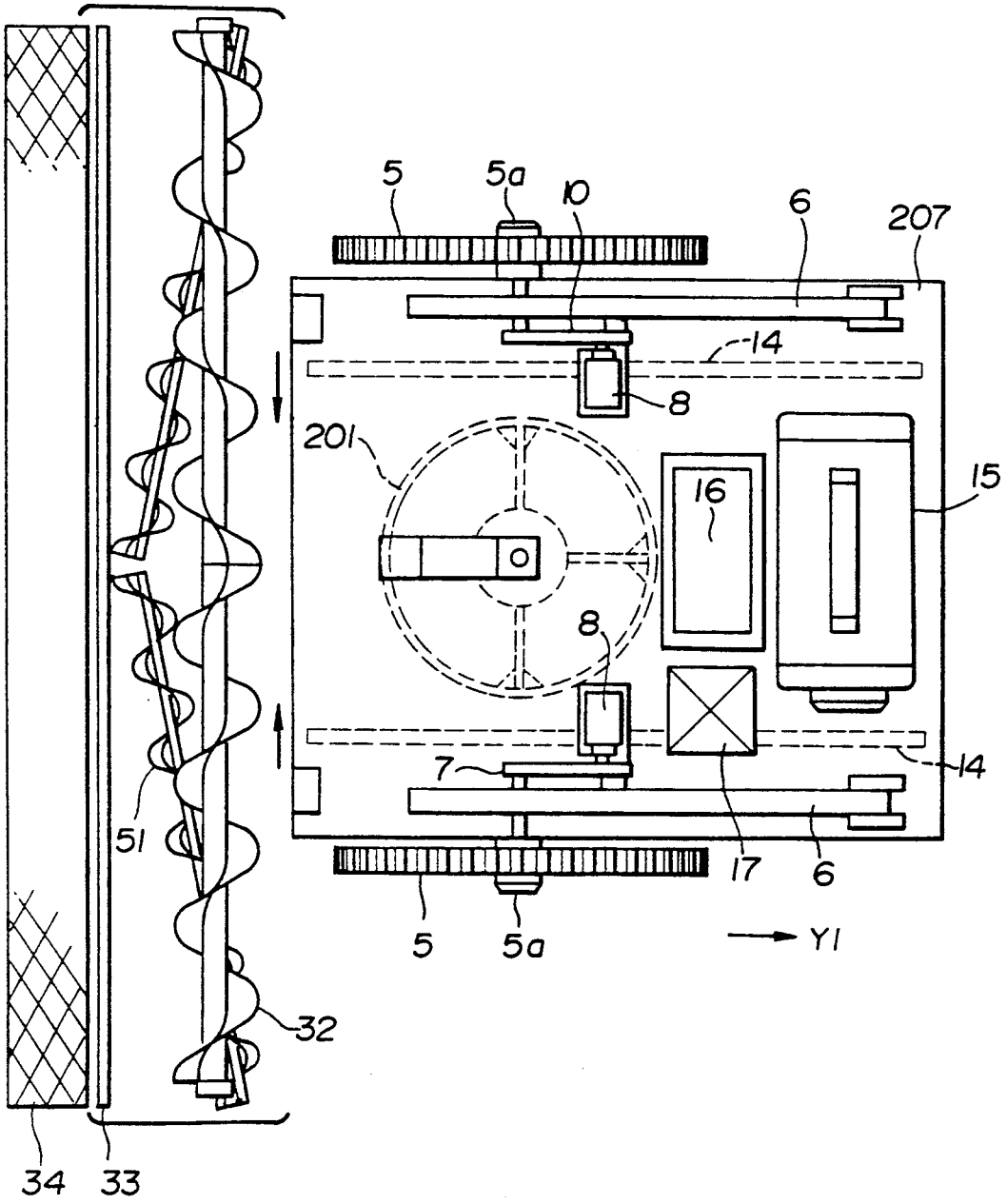
FIG. 15 is a schematic plan view of FIG. 14.
Figure 16:
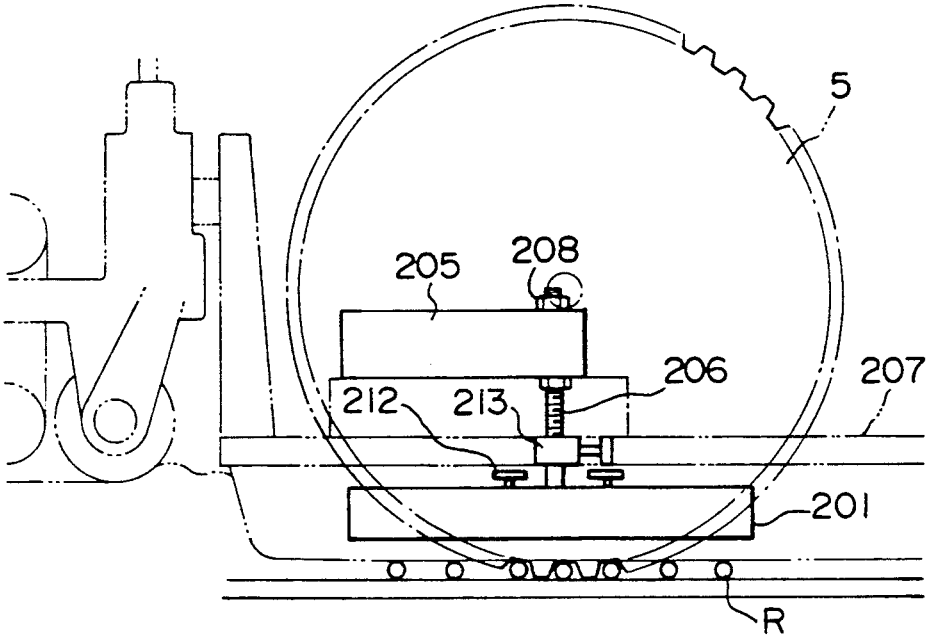
FIG. 16 is a side view of a direction change device of the fourth embodiment.
Figure 17:
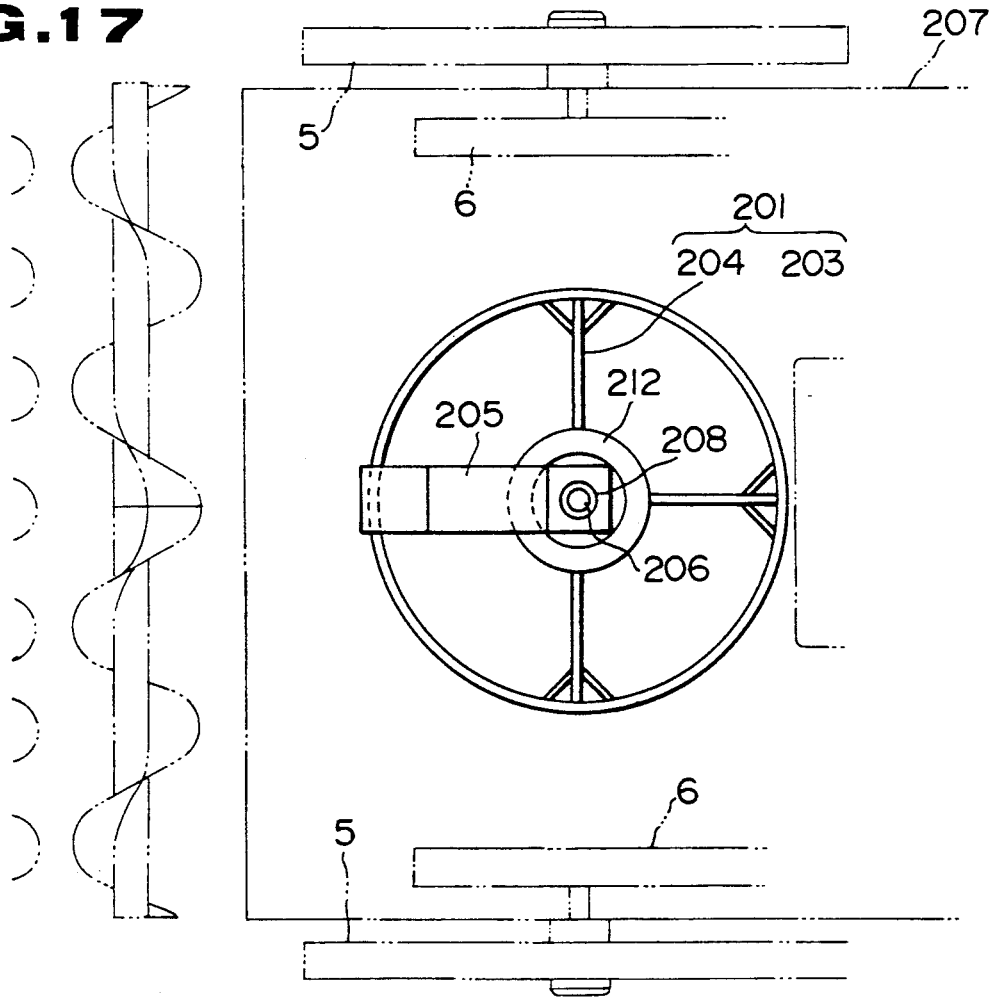
FIG. 17 is a schematic plan view of FIG. 16.
Figure 18:
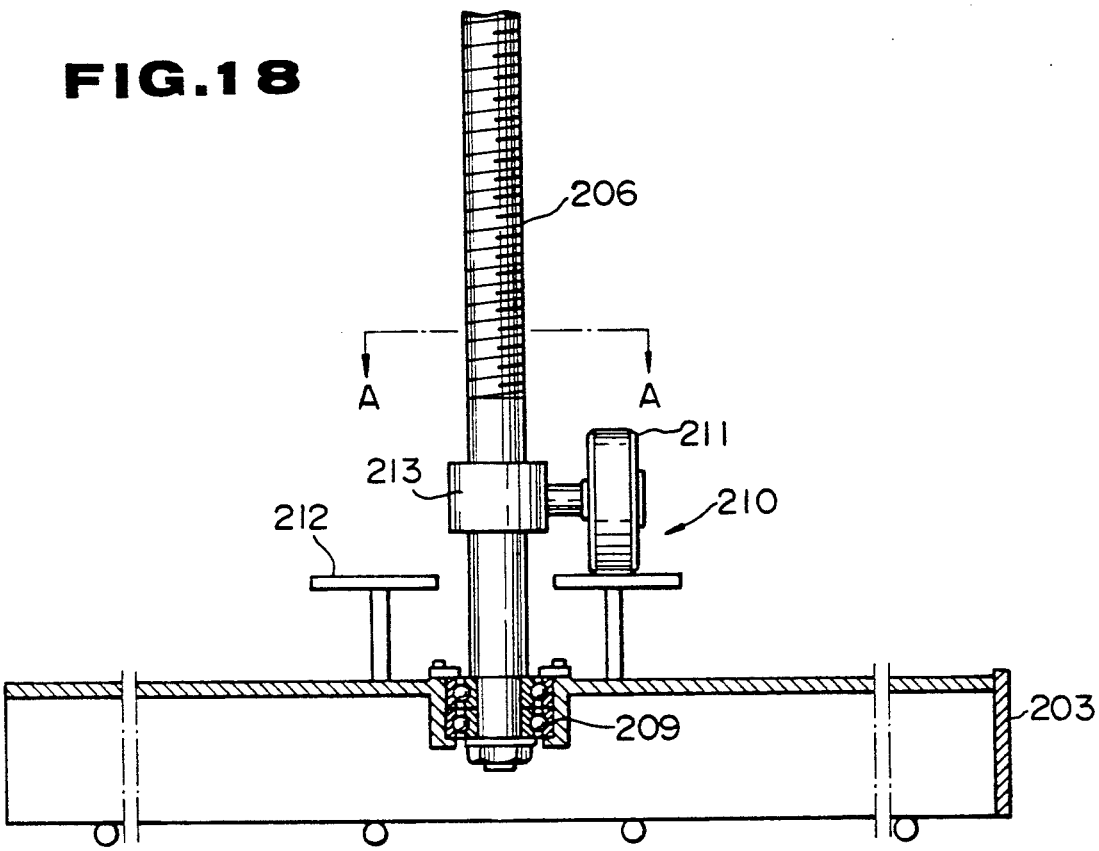
FIG. 18 shows details of the direction change device of FIG. 16.
Figure 19:
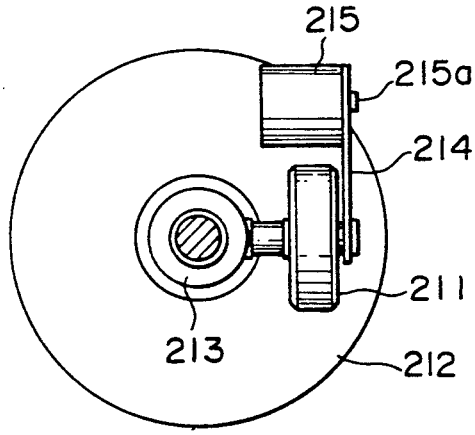
FIG. 19 is a view in the direction of A—A in FIG. 18.

This direction changing device will be explained with reference to FIG. 13 to FIG. 19 in which components similar to the other embodiments are given the same item numbers. As shown in FIG. 13, the direction changing device 200 consists of the wheels 5 and the wheel arms 6 with motors 8 attached, and underneath at a position directly beneath the center of an imaginary line between the centers of both wheels 5, is a support structure 201 (FIG. 14). The motors 8 are fitted with drive pulleys 9 which are connected to pulleys 7 fixed to the wheel axles 5*a* by belts 10 so as to transmit drive in either direction from the motors 8 to the respective wheels. As shown in FIG. 16 and FIG. 17, the support structure 201 consists of an open outer ring 203 with ribs 204 arranged appropriately on its inner circumference. This support structure 201 is rotatably connected in the center region, by means of a bearing 209, to a vertical screw shaft 206 which threads into a thrust sleeve 208 of a support structure actuator 205 attached to the upper face of a platform 207. The support structure 201 is moved up and down by rotation of the thrust sleeve 208 and can rotate independent of the platform 207 by way of the bearing 209, but moves together with the screw shaft 206 in the axial direction. An angular rotation detector 210 shown in FIG. 18 and FIG. 19 consists of a roller 211 in contact with a circular track plate 212 attached to the upper face of the support structure 201 with the axle of the angular rotation detector rigidly attached to a support collar 213 fixed to the lower end of the screw shaft 206. A cylindrical section of the roller 211 is connected by a belt 214 to a pulley on a shaft 215*a* of a rotation detector 215. Depending on rotation of the screw shaft 206, the roller 211 moves around the track plate 212 and its rotation is transmitted t the rotation detector 215 through the belt 214. The rotation detector 215 produces an output signal proportional to the amount of rotation and this is sent to the control unit 16. The rotation detector can be of a standard type such as a rotary encoder etc. type of positional detector. With this device fitted to the leveling machine, when both wheels 5 are turned by motors 8 together, the leveling machine 1 moves in the direction of arrow Y1 (FIG. 13) and the leveling section 22 is inclined at the correct angle to obtain the desired level of the concrete surface, and by operation of the leveling machine over the surface the concrete C1 is leveled. When it is necessary to change the direction, at first the wheels 5 are stopped and then by operation of the support structure actuator 205 in FIG. 16 and FIG. 17 the support structure 201 is lowered to close to the level of the lower face of the stabilizers 14 to contact the rod R. By this operation the load of the leveling machine 1 is shared by the support structure 201, the wheels 5 and the stabilizers 14. Then one wheel is turned in one direction and the other in the opposite direction by motors 8 and by this operation the leveling machine 1 turns about the axis of the screw shaft 206 with support structure 201 remaining stationary.

At this time the angle turned by the leveling machine is detected by the rotation detector 215 (FIG. 19) from signals produced by rotation of the roller 211 on the track plate 212, and sent to the control unit 16. When the turned angle equals a set angle, the control unit 16 sends a command to stop the motors 8 and the wheels stop turning. The support structure actuator 205 then operates to lift the support structure 201 to an upper limit to complete the turning operation. At this time the surface of the concrete C1 is damaged by the wheels 5 and the stabilizers 14, but after completion of the turning operation, it is repaired by the leveling section 22 so there is no problem.

From the above it is obvious that little manual effort is required in changing direction of the leveling machine, and also the leveling section does not need to be stopped during the operation thereby increasing work efficiency.

Also while turning, since the load of the leveling machine 1 is shared between the support structure 201, the wheels 5 and the stabilizers 14, the problem of balance is solved, and disarrangement of the reinforcing rods accompanying wheel reversal is reduced. Also since the support structure 201 does not need a drive to rotate it the mechanism is simple and accordingly maintenance is very easy to perform.

This direction change device 200 is not limited to one using a pair of wheels, and it is also possible to have 2 pairs or more wheels. Also when the wheels 5 are turned in opposite directions, this is achieved by the motors 8 turning either clockwise or counter clockwise, however it is possible to have a drive with a reversing gear etc. instead, to reverse the rotation of the wheels. Also various support structures 201 of different shapes and with different attachment methods etc. can be considered.

Also, although this embodiment it is especially for a direction changing device of a concrete leveling machine 1, the direction changing device is not limited to this application. For example it could be used for a device for placing concrete or some other device for concrete work.

Figure 20:
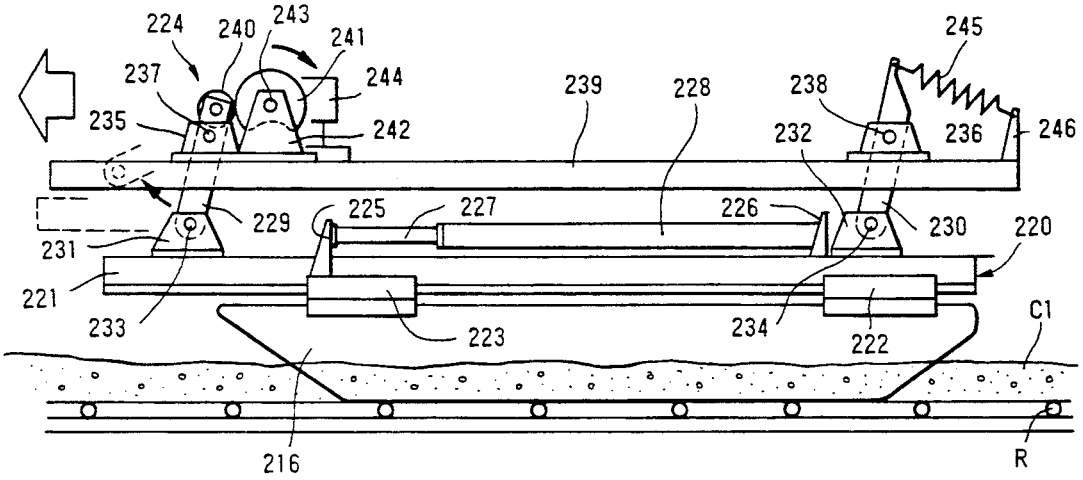
FIG. 20 is a schematic side view of a fifth embodiment of the leveling machine of this invention.
Figure 21:
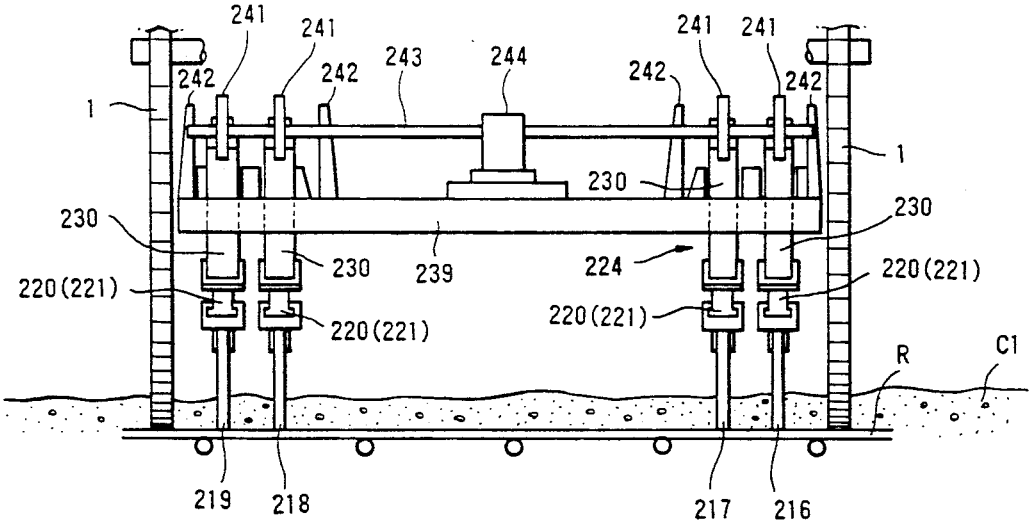
FIG. 21 is an end view of FIG. 20.
Figure 22:
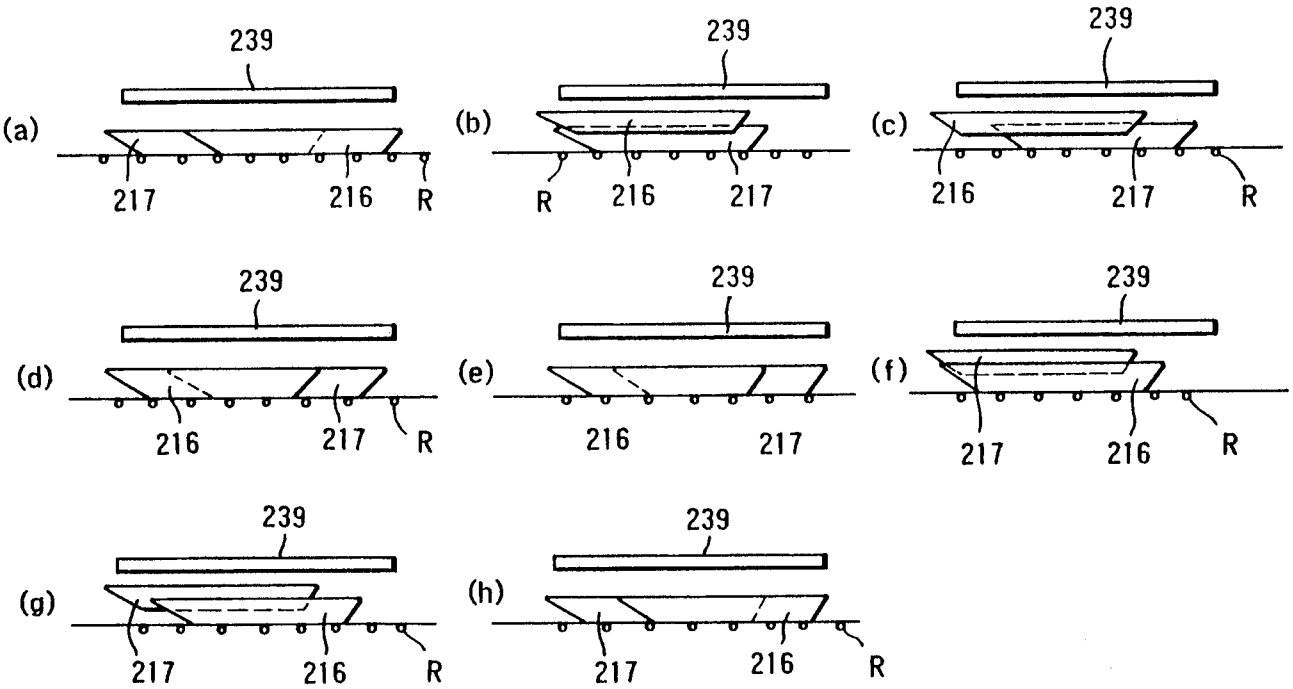
FIG. 22(*a*)–(*h*) shows operating conditions of the fifth embodiment of this invention shown in FIG. 20.

FIGS. 20 to FIG. 22 depict a fifth preferred embodiment of the concrete leveling machine of this invention. The feature of the invention is that another stabilizers 216, 217, 218, and 219 are used instead of the stabilizer 14 shown in FIG. 1.

In FIG. 20 and FIG. 21, linear guides 220 comprise rails 221 extending along the longitudinal direction of the concrete leveling machine, and sliders 222 and 223 slidably engaged to the rails 221 through a bearing or a cylindrical roller bearing. Such linear guides 220 are supported by a vertical motion driving unit 224. This vertical motion driving unit 224 is described later.

The bottom of sliders 222 and 223 are fixedly attached to the top of the stabilizers 216, 217, 218, and 219, respectively. Thus, the stabilizers 216, 217, 218, and 219 are moved along the rails 221.

In addition, each top of the sliders 223 has a bracket 225, the mounting face of which is positioned on the longitudinal axis of the rail 221, while each top of the rails 221 near the sliders 222 has a bracket 226. A resilient member is also arranged on each of rails 221 between bracket 225 and bracket 226. This resilient member comprises a piston 227 and an air-spring portion 228, in which the end of piston 227 is fixedly attached to the bracket 225 and the end of the air-spring portion 228 is fixedly attached to the bracket 226. Thus, each of stabilizers 216, 217, 218, and 219 is normally urged to the traveling direction shown by the arrow.

The vertical motion driving unit 224 supports each of the linear guides 220 by levers 229 and levers 230. These levers 229 and levers 230 are penetrated through openings formed on a platform 239, in which the levers 229 and levers 230 are arranged in two rows on each side of the platform 239 as shown in FIG. 21. One of each of the ends of the levers 229 and levers 230 is pivoted to brackets 231 and brackets 232 by pivots 233 and pivots 234, respectively, in which each of the brackets 231 is fixedly attached to the front side of the rail 221, while each of the brackets 232 is fixedly attached to the rear side of the rail 221. The other each end portion of the levers 229 and levers 230 is pivoted to brackets 235 and brackets 236 by pivots 237 and pivots 238, respectively, in which each of the brackets 235 is fixedly attached to the front side of platform 239, while each of the brackets 236 is fixedly attached to the rear side of the platform 239. With the levers 229, each roller 240 is rotatably attached to the further other end of the levers 229, respectively.

In FIG. 21, each of rollers 240 corresponds to cams 241, each rotation axis of which is fixedly attached to a cam shaft 243 by penetrating the cam shaft 243 into each central opening thereof. The cam shaft 243 is rotatably supported by brackets 242, one pair of which pivotally supports both ends of the cam shaft 243, and the other pair supports the inside of the cam shaft 243 so that two cams 241 are supported between a pair of brackets 242 at both end portions of the cam shaft 243. Each of brackets 242 is fixedly attached to the front near both sides of the platform 239. In the middle position of the cam shaft 243, an electric motor 244 is mounted to rotate the cam shaft 243, with camshaft 243 being connected to a rotating shaft of the electric motor 244.

At the rear end of the device as shown in FIG. 20, the outer end of the levers 230 have one end of a spring 245 attached, the other end of which is attached to a bracket 246 to urge the outer ends of the levers 230 toward the rear side of the platform 239.

Thus, the actuation of the electric motor 244 rotates the cam shaft 243 to rock the levers 229 and 230 about the pivots 237 and 238, respectively, then the stabilizers 216, 217, 218, and 219 move up and down. This movement of the stabilizers 216, 217, 218, and 219 is described later because the movement is associated with the traveling of the concrete leveling machine.

The movement timing of the stabilizers 216, 217, 218, and 219 can be adjusted by the location of the concave portions of the respective cams 241. For example, in FIG. 21, each concave portion of the outer cams 241 is set in the same phase, and that of the inner cams 241 is 180° out of phase with respect to the outer cams 241. Accordingly, when the stabilizers 216 and 219 move upward, the stabilizers 217 and 218 move downward, respectively, by rotating the cams 241.

Next, the operation of the stabilizers 216, 217, 218, and 219 is described by reference to FIG. 22. This FIG. 22 shows that the stabilizers 216 and 217 move up and down with the traveling of the concrete leveling machine. FIG. 22(*a*) shows that each of the stabilizers 216 and 217 is positioned at the down-most position, that is, each bottom portion thereof is in contact with the rods R which are covered by the concrete C1. At this time, the stabilizer 216 is positioned at the rear-most end position with respect to the platform 239 and held against the resilient force of the air-spring portion 228, while the stabilizer 217 is positioned at the front-most end position and urged by the resilient force.

By actuating the electric motor 244 with the traveling of the concrete leveling machine, the cam shaft 243 rotates the cam 241 to move stabilizer 216 upward as shown in FIG. 22(*b*). In FIG. 22(*c*), stabilizer 216 then moves downward after reaching to the up-most position and moves forward along the traveling direction of the concrete leveling machine. In FIG. 22(*d*), the stabilizer 216 moves to the down-most position to contact the rods R. At the same time, the stabilizer 216 is pushed to the front-most end position by the resilient force of the air-spring portion 228, while the stabilizer 217 is positioned at the rear-most end position and held against the resilient force of the air-spring portion 228. In FIG. 22(*e*), the platform 239 is positioned directly above the stabilizers 216 and 217 due to the concrete leveling machine traveling forward.

In the above-described movement of the stabilizers 216 and 217, both stabilizers 216 and 217 do not slide on he rods R because of the friction between the stabilizer 216 or 217 and the rods R. Furthermore, the sliders 222 and 223, fixed to each of stabilizers 216 and 217, slide on the rails 221 with the resilient movement of the pistons 227 with respect to the traveling of the concrete leveling machine.

In FIG. 22(*f*) and FIG. 22(*g*), the stabilizer 217 is moved upward by rotating the cam 241. The stabilizer 217 then moves downward after reaching the up-most position and moves forward along the traveling direction of the concrete leveling machine so that the stabilizer 216 moves up and down as shown in FIG. 22(*b*) and FIG. 22(*c*). In FIG. 22(*h*), the stabilizer 217 then contacts the rods R and is positioned at the front-most end position by the resilient force of the air-spring portion 228, while the stabilizer 216 is positioned at the rear-most end position against the resilient force of the air-spring portion 228. In other words, the stabilizers 216 and 217 return to the initial position as shown in FIG. 22(*a*). The above has been described for the stabilizers 216 and 217, however, since the stabilizers 218 and 219 move similarly to the stabilizers 216 and 217, the description of their operation is omitted for the sake of simplicity.

Accordingly, when the concrete leveling machine moves on the rods R in combination with the sliding movement between the rails 221, and the sliders 222 and 223 fixed to the stabilizers 216, 217, 218, and 219, the stabilizers 216, 217, 218, and 219 do not slide on the rails 221, so that the torque for rotating wheel 1 can be reduced in the traveling of the concrete leveling machine. Furthermore, to pass obstacles such as a conduit, a stud, and like, the concrete leveling machine can be steered so that the path of the stabilizers 216, 217, 218, and 219 clears the obstacles.

What is claimed is:

1. A concrete leveling machine for leveling a surface of laid concrete comprising:

a leveling unit having an adjustable inclination, for leveling the surface of said laid concrete;

a control means for adjusting the inclination of the leveling unit to a desired level for the surface of said laid concrete;

a main platform;

a plurality of wheels arranged on each side of a center line of said main platform;

a wheel support to allow said wheels to move independent of said main platform and maintain a constant vertical load on said wheels;

a drive motor and transmission for rotating each wheel so as to move said concrete leveling machine over the surface of said laid concrete while the leveling unit levels the surface of the concrete; and stabilizers connected to and arranged underneath said main platform and on each side of said center line of the main platform;

wherein said main platform includes means for lifting said concrete leveling machine to facilitate turning said concrete leveling machine by differential rotation of said wheels.

2. A concrete leveling machine according to claim 1 wherein a plurality of reinforcing rods are laid in the concrete, and said wheels have an outer track to grip the reinforcing rods.

3. A concrete leveling machine according to claim 1 wherein said lifting means comprises:

a lifting platform which is supported so as to rotate independent of said main platform; and a lifting actuator which lowers and raises said lifting platform.

4. A concrete leveling machine according to claim 1 wherein the said leveling unit comprises:

a first auger positioned transverse to a direction of motion of said concrete leveling machine;

an auger motor for rotating said auger; and a tamper unit positioned behind said leveling unit;

said auger comprises a left and a right hand screw connected together so that rotation of said auger by said auger motor moves concrete from outer ends of said auger to a central area thereof.

5. A concrete leveling machine according to claim 4 wherein said leveling unit further comprises:

a return flow auger comprising a left hand return flow screw and a right hand return flow screw, both of the return flow screws being positioned behind the first auger; and first and second return flow auger motors respectively connected to the left hand and right hand return screws, to rotate the return flow screws to move concrete from a central area of the return flow auger to a position in front of and near outer ends of said return flow auger.

6. A concrete leveling machine according to claim 5 wherein each of said return flow screws includes a strip of material to mix concrete as the concrete moves from the central area of said return flow auger screw to the outer ends thereof.

7. A concrete leveling machine according to claim 1 wherein:

the leveling unit has an adjustable inclination in a longitudinal direction;

the leveling unit includes a first, longitudinal attachment means for controlling the longitudinal inclination of the leveling unit; and said control means includes a longitudinal attitude laser detector connected to the leveling unit to detect the longitudinal inclination thereof.

8. A concrete leveling machine according to claim 7 wherein the leveling machine is supported for movement in a given direction, and the leveling unit is supported for rotation about an axis transverse to said given direction.

9. A concrete leveling machine according to claim 1, further comprising:

a plurality of additional stabilizers arranged along a traveling direction of said concrete leveling machine and supported to move backward and forward along the traveling direction thereof;

a vertical motion driving unit for moving said additional stabilizers up and down in combination with the backward and forward movement; and a resilient member for urging said additional stabilizers in the traveling direction of said concrete leveling machine, wherein at least one of said additional stabilizers supports the concrete leveling machine as the concrete leveling machine moves down onto said laid concrete.

10. A concrete leveling machine for leveling a surface of laid concrete comprising:

a leveling unit having adjustable longitudinal and lateral attitudes, for leveling the surface of said laid concrete, and including i) first and second ends, each of said ends having an adjustable height, ii) first attachment means for adjusting said lateral attitude by adjustment of the height of each end of the leveling unit, and iii) a second longitudinal attachment means for controlling the longitudinal attitude of the leveling unit, wherein the first attachment supports the leveling unit;

a control means for adjusting the lateral and longitudinal attitude of the leveling unit to a desired level for the surface of said laid concrete, and including i) a reference laser transmitter positioned near an area to be leveled, ii) a level laser detector connected to said leveling unit to detect any difference in level between said leveling unit and a level set by said laser transmitter, iii) a first control unit to convert a signal from said level laser detector to an appropriate signal to operate said first attachment means and to change the height of each end of said leveling unit to produce a desired surface level, iv) a longitudinal attitude laser detector connected to the leveling unit to detect the longitudinal attitude thereof, and v) a second control unit to convert a signal from said longitudinal attitude laser detector to an appropriate signal to drive said second, longitudinal attachment means to change the attitude of said leveling unit in a longitudinal plane;

a main platform;

a plurality of wheels arranged on each side of a center line of said main platform;

a wheel support to allow said wheels to move independent of said main platform and maintain a constant vertical load on said wheels;

a drive motor and transmission for rotating each wheel so as to move said concrete leveling machine over the surface of said laid concrete while the leveling unit levels the surface of the concrete; and stabilizers connected to and arranged underneath said main platform and on each side of said center line of the main platform.

11. A concrete leveling machine according to claim 10, wherein said first attachment means includes a vertical screw, a vertical screw driving actuator fixed to a side of said main platform, and a nut fixed to said leveling unit and threaded on said vertical screw, so that, by rotation of said vertical screw by said vertical screw driving actuator, the height of each end of said leveling unit can be changed.

12. A concrete leveling machine according to claim 10, wherein said second longitudinal attachment means includes a vertical screw, a vertical screw driving actuator fixed to a side of said main platform, and a nut fixed to said leveling unit and threaded on said vertical screw, so that, by rotation of said vertical screw by said vertical screw driving actuator the attitude of said leveling unit in a longitudinal plane can be changed.

13. A concrete leveling machine for leveling a surface of concrete laid over a multitude of regularly spaced reinforcing rods, comprising:

a leveling unit having an adjustable inclination, for leveling the surface of said laid concrete;

a control means for adjusting the inclination of the leveling unit to a desired level for the surface of said laid concrete;

a main platform;

a plurality of wheel arranged on each side of a center line to said main platform;

a wheel support to allow said wheels to move independent of said main platform and maintain a constant vertical load on said wheels;

a drive motor and transmission for rotating each wheel so as to move said concrete leveling machine over the surface of said laid concrete while the leveling unit levels the surface of the concrete; and stabilizers connected to and arranged underneath said main platform and on each side of said center line of the main platform;

wherein each of the wheels includes a multitude of peripheral, protruding teeth to grip the spaced reinforcing rods to facilitate rotating the wheels thereover, so that the wheels can rotate and run on the laid concrete.

* * * * *

UNITED STATES PATENT AND TRADEMARK OFFICE

CERTIFICATE OF CORRECTION

PATENT NO. : 5,129,803

DATED : July 14, 1992

INVENTOR(S) : Hajime Nomura, et al.

It is certified that error appears in the above-identified patent and that said Letters Patent is hereby corrected as shown below:

Column 1, line 68: "he" should read as --the--

Column 4, line 24: "s" should read as --so--

Column 4, line 36: "o" should read as --on--

Column 7, lines 3 & 5: "Ieveling" should read as --leveling--

Column 10, line 34: "t" should read as --to--

Column 13, line 10: "he" should read as --the--

Column 15, line 16, Claim 10: "attachment supports" should read as --attachment means support--

Signed and Sealed this

Fifth Day of October, 1993

*Attest:*

*Attesting Officer*

BRUCE LEHMAN

*Commissioner of Patents and Trademarks*